US005445536A

United States Patent [19]

Chen

[11] Patent Number: 5,445,536

[45] Date of Patent: Aug. 29, 1995

[54] QUICK MOUNTING BULB SOCKET

[76] Inventor: Jeng-Chih Chen, No. 32, Lane 568, Chung Shan Rd., Sec. 2, Chung Ho City, Taipei Hsien,

[21] Appl. No.: 305,362

[22] Filed: Sep. 13, 1994

[51] Int. Cl.[6] ..... H01R 4/24

[52] U.S. Cl. ..... 439/419; 439/409

[58] Field of Search ..... 439/417, 419, 425, 395, 439/409, 410, 414

[56] References Cited

U.S. PATENT DOCUMENTS 2,636,069 1/1949 Gilbert ..... 439/417

4,754,104 6/1988 Maltais et al. ..... 439/417

*Primary Examiner*—Larry I. Schwartz

*Assistant Examiner*—Jill DeMello

*Attorney, Agent, or Firm*—Beveridge, DeGrandi, Weilacher & Young

[57] ABSTRACT

A quick mounting bulb socket is equipped with a socket body having bulb retaining threads defined in the interior of the socket body, and a pair of sharp pointed conducting pins each having a pointed piercing end which can penetrate the skin of an electric wire and make contact with the metallic conductor thereof. Electric wires are first located in wire retaining grooves and a rotation pressing knob mounted onto the socket body is turned through 90 degrees, urging the wires to abut against the sharp pointed conducting pins which will then directly contact the conductor of the wires. In this manner, the bulb socket becomes electrically wired to a power supply line.

17 Claims, 4 Drawing Sheets

QUICK MOUNTING BULB SOCKET

BACKGROUND OF THE INVENTION

The present invention relates to a quick mounting bulb socket which can be connected readily to a power line without the need to remove the insulating skin of the power line at the terminal end and securing the end of the line to the socket mount by screws.

Conventional bulb sockets are electrically connected to power supply lines by connecting the sockets to the electric wires by first removing the insulation from the terminals of the wires. The terminals are then fixed to the sockets by screws. Those sockets are usually secured to ceilings, walls, and similar places that are often beyond the reach of the hands of people. Thus, the preceding operations can become difficult and tedious.

SUMMARY OF THE INVENTION

The primary object of the present invention is to provide a quick mounting socket which can be coupled to a power line without cutting and removing the insulation from electric wires and fixing the electric wires to the socket by a screwdriver.

Another object of the present invention is to provide a quick mounting socket which is provided with sharp pointed pins which can penetrate the electric wires of the power line and abut against the electrical conductor of the electrical wires with speed.

According to the present invention, there is provided a bulb socket for quick mounting a wire or wires comprising a socket body having at least one electrically conducting pin, means for locating at least one wire in the socket body, electrical conductor means and means for causing the pin to penetrate a wire located in the socket body and to move into contact with the conductor means. Sharp pointed pins, are thus used which penetrate the insulating skin of the wires, and move into contact with the metallic conductor of the same so as to permit the power line to be electrically engaged with the bulb socket. The wires of the power line are first located inside the bulb socket just above the pointed pins and retained in place. The wires are further forced gradually against the pointed pin by a rotatably operated cap so that the bulb socket can be coupled to the power line with speed.

BRIEF DESCRIPTION OF THE DRAWINGS

FIG. 4A is a diagram showing the wire retaining member of the socket of FIG. 1;

FIG. 4B is a diagram of the side conducting pin shown in FIG. 4;

DETAILED DESCRIPTION OF THE PREFERRED EMBODIMENT

Figure 1:
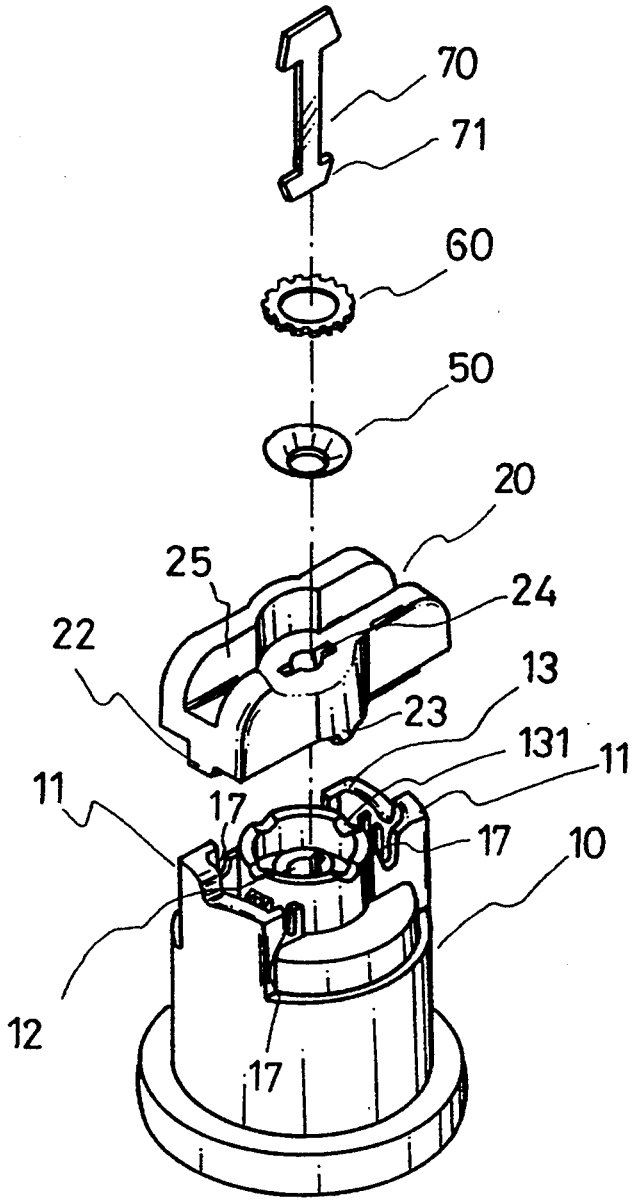
FIG. 1 is a diagram showing an exploded view of the socket of the present invention.
Figure 2:
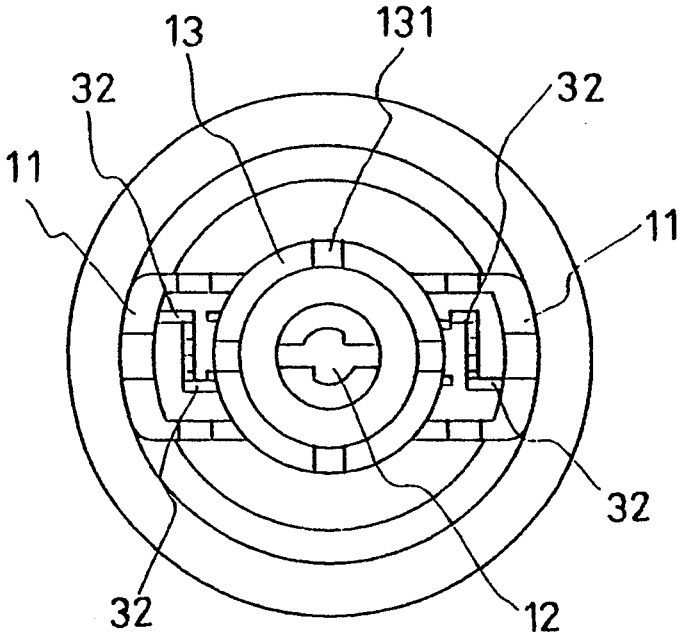
FIG. 2 is a plan view of the socket of FIG. 1.
Figure 3:
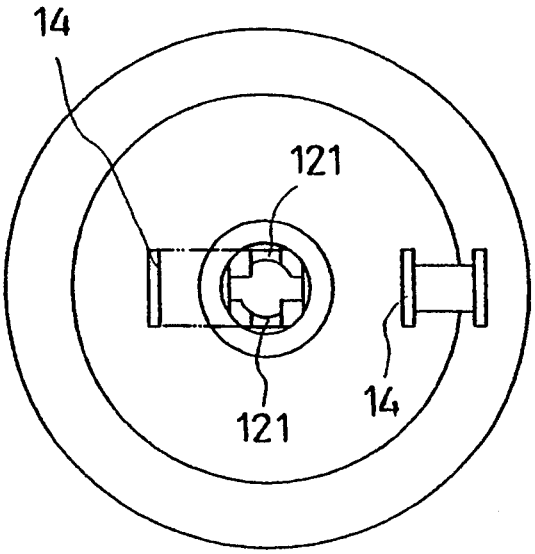
FIG. 3 is an underneath plan view of the socket of FIG. 1.
Figure 4:
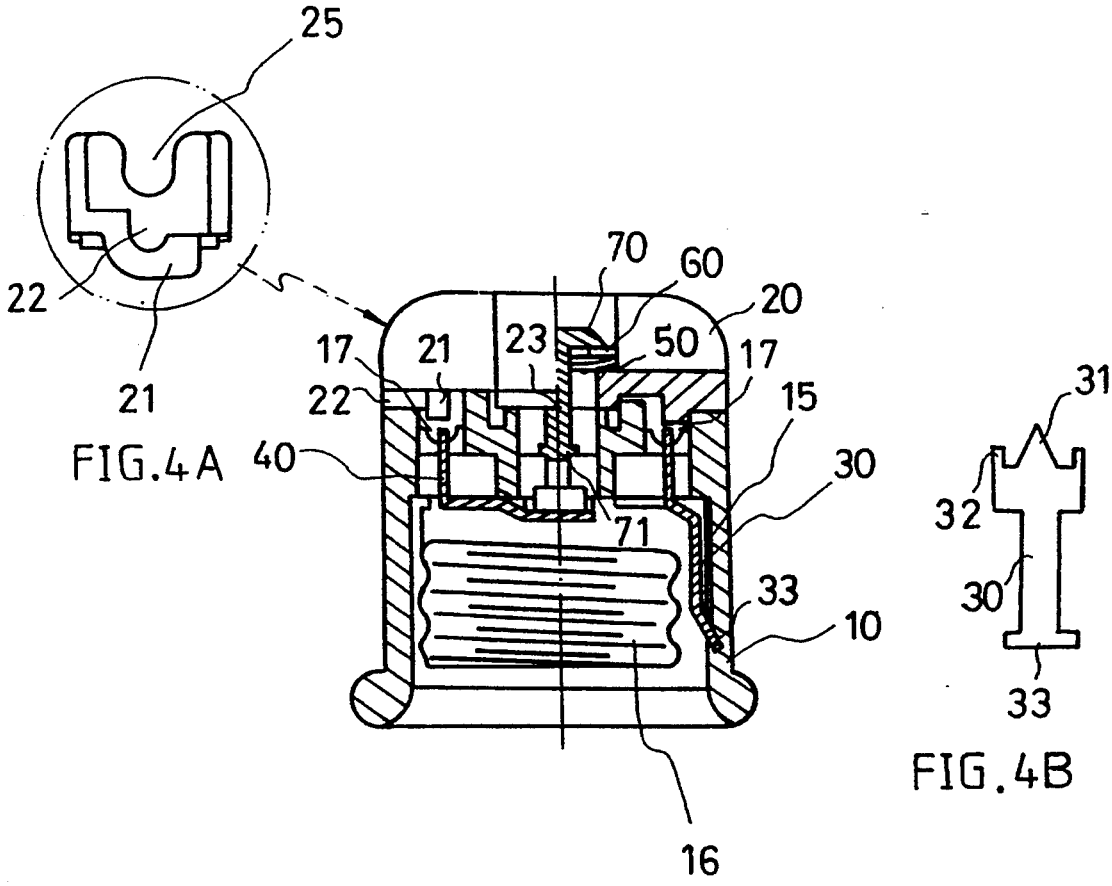
FIG. 4 is a side sectional view of the socket of FIG. 1.

Referring to FIGS. 1, 4, 4A and 4B, the bulb socket includes a socket body 10, a rotatable pressing knob 20, a sharp pointed side conducting pin 30, a central conducting pin 40 a resilient unit 50, a washer 60, and a connection pin 70.

The socket body 10 is provided with integrally molded bulb securing threads 16 with a mounting groove 15 defined next to the inner threads 16 for the fixing of the side conducting pin 30. The side conducting pin 30 has a reversed T-shaped end 33. The elasticity of the conducting pin 30 can help keep the mounted bulb firmly abutted against the conducting pin 30 itself, making the electric connection stable.

Referring also to FIGS. 2, 3, 5A and 5B, the sharp points 31 of the conducting pins 30 and 40 respectively are pushed through the fixing slots 14 disposed at the top of the socket body 10, cooperating with the protrusions 21 of the rotatable pressing knob 20. The insulating skin of the electric wires 80 which are located in retaining grooves 17, are thus pierced by the sharp pointed conducting pins 30, 40 which abut directly against Conducting part of the wires 80.

There are two lugs 11 disposed on the top periphery of the socket body 10. The neighboring concavities are engaged with the positioning protrusions 22 disposed under the rotatable pressing knob 20 so as to limit the rotation of the pressing knob 20 to just 90 degrees.

At the center of the socket body 10 is disposed a central opening 12 in which is located the reversed T-shaped bottom end 71 of the connection pin 70. A pair of symmetric grooves 121 are disposed perpendicularly to the central opening 12 so that the T-shaped bottom end 71 can engage therewith as the pressing knob 20 is turned through 90 degrees.

At the top of the socket body 10 and between the lugs 11 is disposed a cylindrical protrusion 13, and on the peripheral edge thereof are placed two sets of arc recesses 131 arranged in a cross-wise manner. Corresponding to the arc recesses 131 are a pair of retaining projection spots 23 at the bottom of the pressing knob 20 which are firmly engaged with two of the arc recesses 131 as the pressing knob 20 is placed either in its original position or is turned through 90 degrees. Adjacent to the cylindrical projection 13 are disposed wire retaining grooves 17 at each side thereof for securing the electrical wires.

The pressing knob 20 is mounted to the top of the socket body 10 in the following manner. The connection pin 70 having the reversed T-shaped bottom end 71 is pushed through a washer 60, a resilient unit 50 and further guided into the through hole 24 disposed at the center of the pressing knob 20, ad finally into the central opening 12 of the socket body 10. Afterwards, the pressing knob 20 is turned through 90 degrees so that the reversed T-shaped bottom end 71 of the connection pin 70 can engage with the symmetric grooves 121 and retain the pressing knob 20 in place.

The top of the rotation pressing knob 20 is provided with a receiving group 25 in which are housed the connection pin 70, the washer 60 and the resilient unit 50. The resilient unit 50 exerts a compressing force on the Wires so as to effect the connection. The washer 60 enables the pressing knob 20 to rotate smoothly.

To fix the conducting pins 30 and 40 in place, they are provided with a sharp pointed piercing end 31 and two securing legs 32. The pins are guided through the fixing slot 14 first and then the legs 32 are bent horizontally in abutment against the socket body 10 so as to fix the conducting pins 30, 40 in place. The T-shaped end of the conducting pin 30 must, however, be first located in the mounting groove 15 on the socket body 10.

Figure 5A:
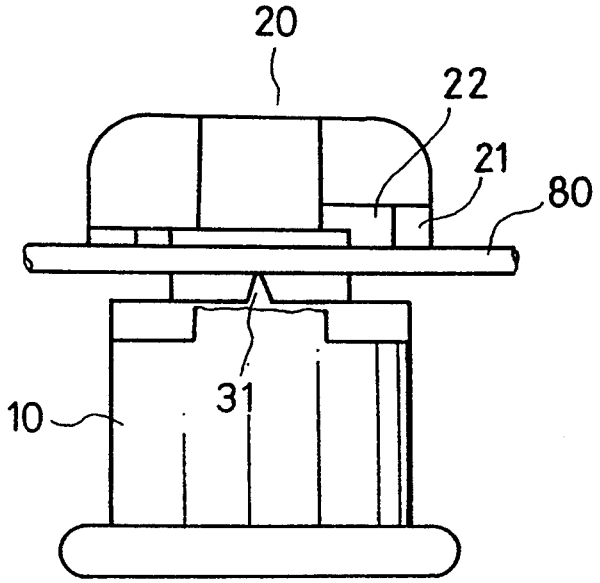
FIG. 5A is a side elevation of the socket of FIG. 1 showing the pointed pin and the electric wire before engagement.
Figure 5B:
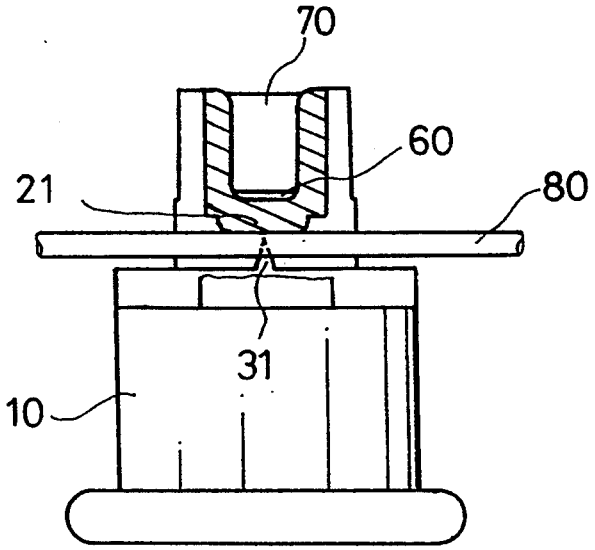
FIG. 5B is a side elevation of the socket of FIG. 1 showing the engagement of the pointed pin and the electric wire by the rotatable pressing knob.

Referring to FIGS. 5A and 5B, the electric wires 80 are placed in the retaining grooves 17 first with the pressing knob 20 in parallel With the wires 80. As the pressing knob 20 is turned through 90 degrees, the urging projections 22 of the pressing knob 20 will push the wires 80 downwardly against the pointed piercing end 31 so as to make the socket body electrically connect to the wires with ease.

I claim:

1. A bulb socket for quick mounting a wire or wires, comprising:

a socket body having at least one electrically conducting pin, wherein the socket body includes two lugs at a top periphery thereof with a cavity adjacent thereto; wherein a cylindrical projection is disposed at the top of said socket body and between said lugs, and four arcuate recesses are disposed on a peripheral edge of said cylindrical projection, such that the arcuate recesses are located at crosswise positions; wherein a central opening is defined at a center of said cylindrical projection;

means for locating at least one wire in the socket body, wherein the means for locating includes at least one wire retaining groove located adjacent to said cylindrical projection;

electrical conductor means including a pair of conducting pins each having a sharply pointed piercing end, wherein each conducting pin is led through a fixing slot defined in said socket body; and means for causing the conducting pins to penetrate a wire or wires located in the socket body and to move the wire or wires into contact with the electrical conductor means;

wherein integral bulb securing threads are disposed on said socket body for mounting a bulb to the socket body; a conducting pin insertion groove is defined adjacent to said bulb securing threads for securing one of said conducting pins;

wherein the means for causing includes a pressing knob having a pair of urging protrusions and positioning protrusions disposed thereunder and a pair of retaining projection spots which are selectively engaged with said arcuate recesses; and a receiving groove is disposed on a top of said pressing knob for housing a washer and a resilient plate; wherein a connection pin having a T-shaped end is passed through said washer, through said resilient plate and into a through hole defined in said pressing knob; said pressing knob being rotatably mounted onto said socket body; and said connection pin being further passed to said central opening of said socket body; said pressing knob being turned through 90 degrees with said T-shaped end of said connecting pin engaged with two grooves on said socket body so as to move said socket body and said pressing knob together with one another; said conducting pins being led through said fixing slots respectively, wherein said conducting pins include two legs adjacent to said pointed piercing end thereof, said legs being horizontally bent so as to fix the conducting pin to said socket body; said at least one wire being disposed in said wire retaining grooves and engaged with said conducting pin which can penetrate a skin of the at least one wire as said at least one wire is being forced toward the conducting pin.

2. A bulb socket, comprising:

a socket body including two lugs at a top periphery thereof, a cylindrical projection disposed at the top of the socket body between the lugs, wherein a central opening is defined at a center of the cylindrical projection;

means for locating at least one wire in the socket body, wherein the means for locating includes a wire retaining groove defined adjacent to the cylindrical projection;

electrical conductor means including a conducting pin having a sharply pointed piercing end, wherein the conducting pin is received in a fixing slot defined in the socket body; and means for causing rotatably mounted on the socket body so as to be movable along the two lugs of the socket body, wherein the means for causing causes the conducting pin to penetrate a wire located in the means for locating in the socket body, to thereby electrically connect the conducting pin with the wire;

whereby when a wire is disposed in the wire retaining groove of the means for locating, the wire may be engaged with the conducting pin when the conducting pin penetrates the wire under rotary action of the means for causing.

3. A bulb socket according to claim 2, wherein the means for locating includes two wire retaining grooves defined adjacent to the cylindrical projection.

4. A bulb socket according to claim 3, wherein the electrical conductor means includes two conducting pins, each conducting pin received in a separate fixing slot defined in the socket body.

5. A bulb socket according to claim 2, wherein the electrical conductor means includes two conducting pins, each conducting pin received in a separate fixing slot defined in the socket body.

6. A bulb socket according to claim 2, further including bulb securing threads disposed on the socket body for securing a bulb to the socket body.

7. A bulb socket according to claim 6, wherein a conducting pin insertion groove is defined adjacent to the bulb securing threads, wherein the conducting pin is partially situated within the conducting pin insertion groove.

8. A bulb socket according to claim 2, wherein the means for causing includes a pressing knob having a pair of urging protrusions and a pair of positioning protrusions disposed under the urging protrusions.

9. A bulb socket according to claim 8, wherein the means for causing includes a pair of retaining projection spots which are movably engaged with arcuate recesses defined in the cylindrical projection of the socket body.

10. A bulb socket according to claim 8, wherein the pressing knob includes a receiving groove defined at a top of the pressing knob.

11. A bulb socket according to claim 10, wherein a washer and a resilient plate are fixed in the receiving groove by a connection pin which extends through the washer and resilient plate.

12. A bulb socket according to claim 11, wherein the connection pin has a T-shaped end which passes through the washer, the resilient plate and into a through hole defined in the pressing knob.

13. A bulb socket according to claim 12, wherein the connection pin passes through the central opening defined in the socket body.

14. A bulb socket according to claim 8 wherein the pressing knob of the means for causing is rotatably mounted onto the socket body.

15. A bulb socket according to claim 14, wherein the pressing knob is rotatable through 90 degrees, thereby moving the socket body against the pressing knob.

16. A bulb socket according to claim 2, wherein the conducting pin includes two legs adjacent to the pointed piercing end thereof.

17. A bulb socket according to claim 16, wherein the legs are bent so as to fix the conducting pin to the socket body.

* * * * *